US010654093B2

(12) United States Patent
Hill et al.

(10) Patent No.: US 10,654,093 B2
(45) Date of Patent: May 19, 2020

(54) RIVETING APPARATUS WITH MOVEABLE NOSE PORTION TO MATCH AN ADJOINING RIVET FEED TRACK

(71) Applicant: ELECTROIMPACT, INC., Mukilteo, WA (US)

(72) Inventors: Jeffrey M. Hill, Mill Creek, WA (US); Peter B. Zieve, Seattle, WA (US)

(73) Assignee: Electroimpact, Inc., Mukilteo, WA (US)

( * ) Notice: Subject to any disclaimer, the term of this patent is extended or adjusted under 35 U.S.C. 154(b) by 178 days.

(21) Appl. No.: 16/031,285

(22) Filed: Jul. 10, 2018

(65) Prior Publication Data

US 2020/0016649 A1 Jan. 16, 2020

(51) Int. Cl.

| | |
|---|---|
| ***B21J 15/02*** | (2006.01) |
| ***B21J 15/12*** | (2006.01) |
| ***B21J 15/28*** | (2006.01) |
| ***B21J 15/32*** | (2006.01) |

(52) U.S. Cl.

CPC ..... *B21J 15/025* (2013.01); *B21J 15/12* (2013.01); *B21J 15/28* (2013.01); *B21J 15/32* (2013.01)

(58) Field of Classification Search

CPC . B21J 15/00; B21J 15/02; B21J 15/025; B21J 15/12; B21J 15/28; B21J 15/32; Y10T 29/5377; B25J 15/10; B25J 15/12

See application file for complete search history.

(56) References Cited

U.S. PATENT DOCUMENTS

| | | | | |
|---|---|---|---|---|
| 3,646,660 | A * | 3/1972 | Sheffer, Jr. | B21J 15/02 29/243.53 |
| 4,044,462 | A * | 8/1977 | Anselmo | B21J 15/32 29/809 |
| 5,123,162 | A * | 6/1992 | Wing | B21J 15/32 29/809 |
| 5,236,341 | A * | 8/1993 | Stafford | B21J 15/32 221/200 |
| 5,611,130 | A | 3/1997 | Rummell et al. | |
| 6,692,213 | B1 * | 2/2004 | Butler | B21J 15/025 414/412 |
| 2008/0247844 | A1 * | 10/2008 | Hartrampf | B21J 15/043 414/4 |
| 2014/0217227 | A1 * | 8/2014 | Kilibarda | B21J 15/323 242/555.3 |

* cited by examiner

*Primary Examiner* — Tyrone V Hall, Jr.
(74) *Attorney, Agent, or Firm* — Clark A. Puntigam; Jensen & Puntigam PS

(57) ABSTRACT

A nose portion assembly of a riveting apparatus is rotatable between a first vertical position and a second angled position which is adjacent an end of a rivet feed ramp. The angled position of the nose assembly matches the angle of a rivet feed ramp from a rivet feed member positioned on the side of the riveting apparatus.

7 Claims, 4 Drawing Sheets

RIVETING APPARATUS WITH MOVEABLE NOSE PORTION TO MATCH AN ADJOINING RIVET FEED TRACK

TECHNICAL FIELD

This invention relates generally to large-scale riveting assemblies, and more specifically to such an assembly or apparatus which is configured and arranged to reliably receive rivets from a rivet source thereof for insertion into a workpiece

BACKGROUND OF THE INVENTION

Automatic riveting assemblies, such as used in large-scale riveting operations for aircraft for example, typically include a rivet insertion assembly which utilizes fingers at the end of the insertion assembly to grasp a rivet, which is then inserted into a pre-drilled opening in a workpiece by a ram assembly acting on the rivet insertion assembly. Once the rivet is inserted, the ram assembly is used to upset the rivet, thereby completing a riveting cycle. Such automatic riveting machines typically operate with a rivet feed system in which rivets move from a storage hopper to the rivet insertion assembly fingers. In many arrangements, the feed system includes a ramp or a track which extends from the storage hopper to a position adjacent the rivet insertion assembly, at which point the rivet is injected into the insertion assembly fingers.

In vertical axis riveting, the workpiece is in a horizontal plane and the riveting is perpendicular to the workpiece. The rivet track or ramp is usually at a 30 degree angle ±10 degrees depending on style from the horizontal, so that the rivets slide down the track by gravity, which however results in an angular mismatch between the rivet track and the vertical fingers of the rivet insertion assembly. This mismatch results in jams and other compromises in operation of the riveting apparatus.

SUMMARY OF THE INVENTION

Accordingly, a riveting apparatus is disclosed comprising: a riveting assembly arranged for vertical riveting with a plurality of riveting tools, including a drill for drilling a hole in a workpiece and an upper ram assembly; a nose assembly pivotally connected to the upper ram assembly having a rivet finger assembly at a lower end thereof, wherein the pivoting nose portion in operation moves between a first vertical position and a second angled position; and a feed mechanism for feeding rivets from a rivet supply member, wherein the rivets slide downwardly along a rivet feed ramp which is positioned at a selected angle, wherein the nose assembly in its second position is at an angle which matches the angle of the feed ramp, wherein in operation the nose assembly moves from the first position to the second position, where the finger assembly receives a rivet from the rivet feed assembly and then moves back to the first position for insertion of the rivet into a drilled opening in the workpiece where thereafter the rivet is upset.

BEST MODE FOR CARRYING OUT THE INVENTION

Figure 1:
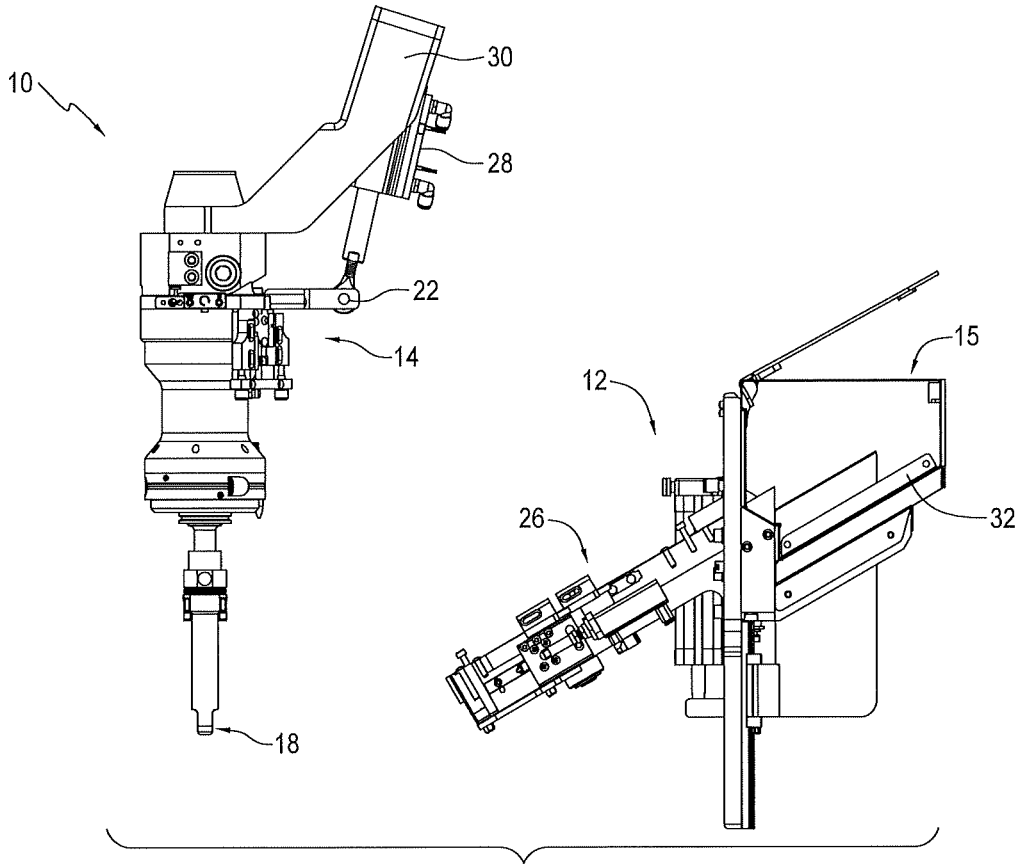
FIG. 1 is an elevational view showing the combination of a rivet insertion assembly in a first position relative to a rivet feed assembly.

FIG. 1 shows in partial representational form a riveting assembly 10 along with a rivet feed assembly 12. The automatic riveting assembly 10 includes a rivet insertion mechanism, also known as a nose portion, 14. The nose portion 14 includes a rivet holding mechanism, namely a segmented expandable finger assembly 18 at a lower end thereof. The finger assembly 18 is conventional. It is spring loaded so the fingers can be forced apart to receive a rivet and then closed tightly around the received rivet. The rivet insertion assembly is driven by a upper ram assembly 20 which in operation drives a rivet positioned in the finger assembly 18 into a previously drilled hole in a workpiece (not shown). In one application, the riveting assembly is used for large-scale manufacturing operations, with the workpiece being an aircraft panel.

The nose portion 14 is pivotally mounted at the lower end of the ram assembly 20 by a pivot member 22. In the present invention, the pivot angular range can vary depending upon the configuration of the rivet feed assembly. Typically, the rivet feed assembly includes an angled track 26 along which rivets move by gravity. The track is positioned at a specific angle from the horizontal. The range of pivot motion of the nose portion 14 permits matching the nose portion angle with the angle of the rivet feed track 26. Generally, this angle would be somewhere in the range of 25-45 degrees, and in one example is preferably 30 degrees. The pivoting action of member 22 can be controlled by various arrangements, including an air cylinder shown at 28 mounted on an assembly brace member 30. As indicated above, the first or base position of the nose portion 14 in operation of the assembly is vertical as shown in FIG. 1, with the system arranged for vertical axis riveting of the workpiece.

Figure 2:
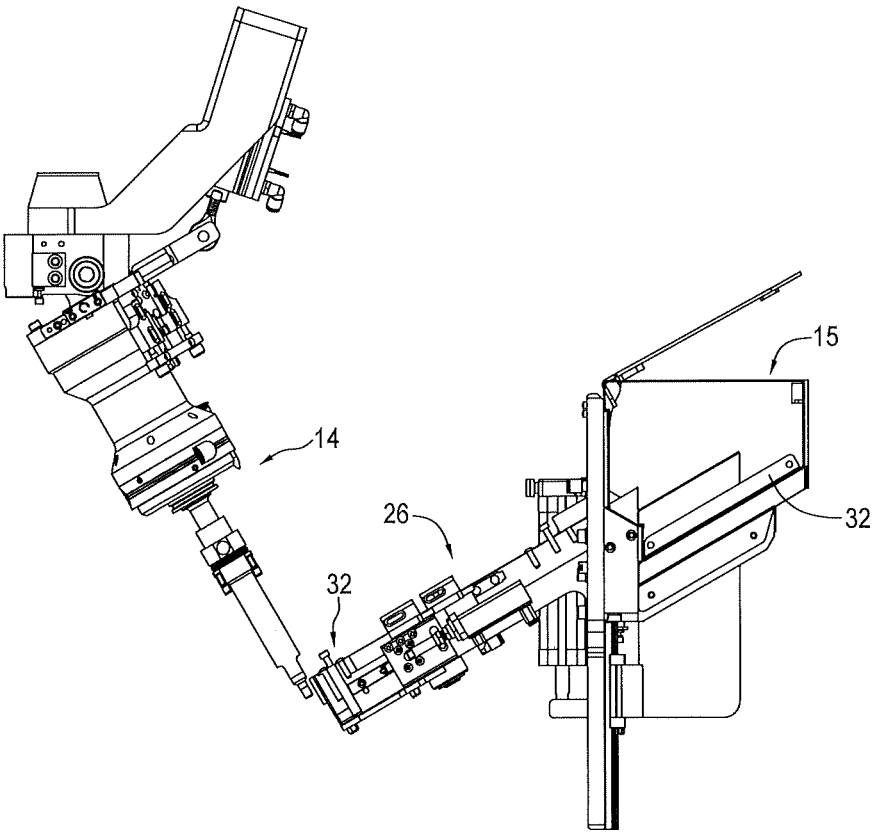
FIG. 2 is an elevational view of the rivet insertion assembly in a second position adjacent to the rivet feed assembly.
Figure 3A:
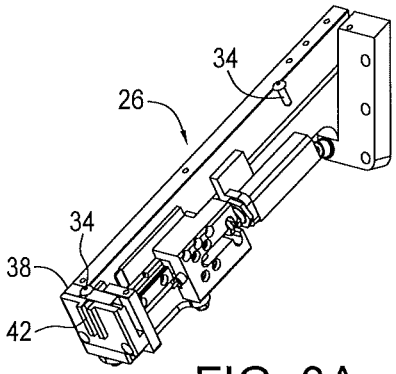
FIG. 3A is a schematic view of the rivet feed assembly in a first position.
Figure 3B:
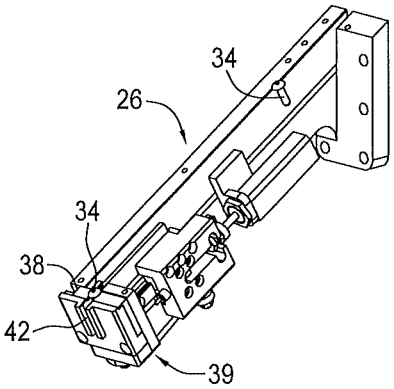
FIG. 3B is a schematic view of the rivet feed assembly in a second operational position.
Figure 3C:
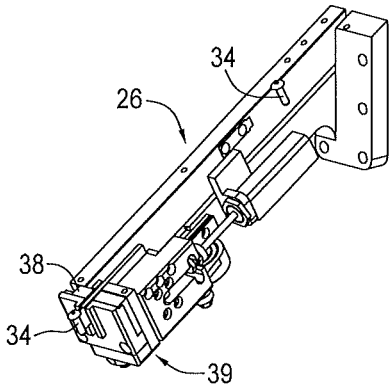
FIG. 3C is a schematic view of a rivet feed system in a third operational position.

In its first operational position, the nose portion 14 is located a distance away from the end of the rivet feed track. Typically this might be in the range of 8-10 inches. FIG. 2 shows the nose portion 14 in its second operational position, at an angle which is at 90 degrees relative to the direction of the rivet feed track 26. Thus, in the second operational position, fingers 18 of the nose portion 14 are adjacent the distal end 36 of the rivet feed track, awaiting the insertion of a rivet from the rivet feed track. FIGS. 3A, 3B and 3C show the operation of the rivet feed assembly, as rivets move from storage hopper 15. In operation, rivets in the storage hopper 15 fall onto a holding bar 32 in the storage hopper. The rivets position themselves head side up on the holding bar.

The holding bar 32 is then moved up to join the feed ramp 26 which extends from the hopper. As indicated above, in the arrangement shown, the feed ramp 26 is positioned at an angle, approximately 30 degrees (±10 degrees) downwardly relative to the horizontal. Other angular arrangements are possible. The individual rivets 34 move along the ramp or track 26 as shown in FIGS. 3A, 3B and 3C. The individual rivets from the hopper tend to stack up along the length of the feed ramp 26. As indicated above, the rivets slide down individually along the ramp by gravity action, due to the 30° angle, hanging from their heads, a correct orientation for insertion into the fingers on the nose portion in its second operating position. An air cylinder 36, which guides the rivet into the fingers 18 on the nose portion also pushes a rivet separator 38, which is a sliding plate with a notch to accept the rivet, along a cam path which is positioned near the forward end of an injector portion 39 of the feed ramp 34. The separator/slider 38 separates a single rivet from the feed ramp, and aligns it with an opening 42 at the forward end of the feed ramp, in registry with the fingers 18 of the adjacent nose portion 14.

Figure 4:
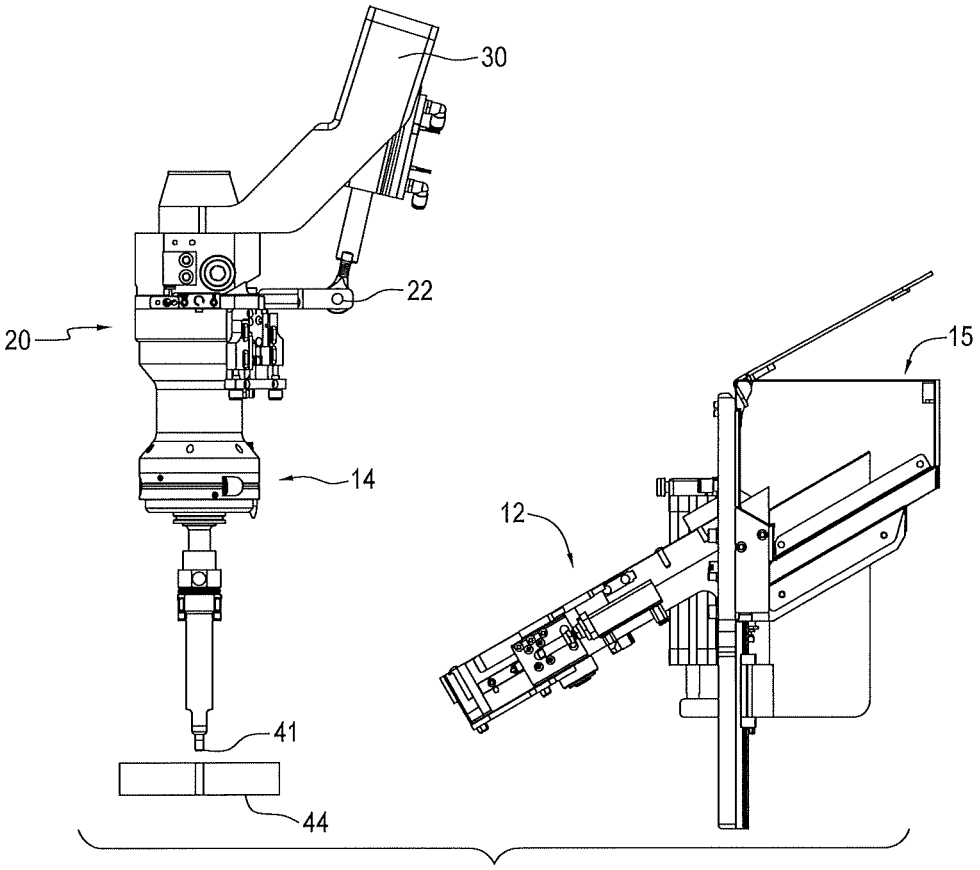
FIG. 4 is an elevational view of the rivet insertion assembly back in its first position holding a rivet receiver from rivet feed assembly.

In a conventional system, the separator is at an angle to the nose portion fingers which causes problems with reliable delivery of rivets as discussed above A pusher bar 44 moves the rivet out of the end of the injector 39 and to the fingers 18, forcing the rivet into the fingers 18. FIG. 3C shows the rivet having been injected from the ramp, but without showing the fingers of the nose portion, for clarity. FIG. 4 shows a rivet 41 positioned in the fingers in the nose portion, with the nose portion back to its first, vertical position. Air cylinder 28 in operation rotates the nose portion 14 back to its vertical position above the workpiece. The upper ram 20 then moves the nose portion downwardly at a selected rate inserting the rivet in the drilled hole in the workpiece 44, which is firmly held down. A complementary conventional lower ram comes up from the bottom (not shown) beneath the workpiece and squeezes, i.e. upsets, the rivet to complete the rivet operation. The ram assembly is then retracted to its original position as shown in FIG. 1, to await the next cycle of operation.

Hence, a riveting assembly has been disclosed which includes a nose portion which is partially rotatable or tippable, to bring the fingers of the nose portion to angularly match the angle of the ramp river feed assembly. This results in fewer jams and hence more effective and efficient rivet feeding and riveting operations.

A wide variety of rivet types can be accommodated with the present system, from as short as 5/16 inches to 2 inches. The rivet feed hopper can be mounted further away from the upper ram than otherwise in conventional arrangements, due to the pivoting movement of the nose position. A series of hoppers can as a result be moveably arranged in a straight line along the side of the riveting apparatus, so that the different size rivets can be readily accommodated, by simply moving the hopper with the correct size rivets into position, without having to remove one hopper and replace it with another feed hopper in order to change rivets.

Although a preferred embodiment of the invention has been disclosed for purposes of illustration, it should be understood that various changes, modifications and substitutions can be made without departing from the spirit of the invention, which is defined by the claims which follow.

What is claimed is:

1. A riveting apparatus comprising:

a riveting assembly arranged for vertical riveting with a plurality of riveting tools, including a drill for drilling a hole in a workpiece and an upper ram assembly;

a nose assembly pivotally connected to the upper ram assembly having a rivet finger assembly at a lower end thereof, wherein the pivoting nose assembly in operation moves between a first vertical position and a second angled position; and a feed mechanism for feeding rivets from a rivet supply member, wherein the rivets slide downwardly along a rivet feed ramp which is positioned at a selected angle, wherein the nose assembly in its second position is at an angle which matches the angle of the feed ramp, wherein in operation the nose assembly moves from the first position to the second position, where the finger assembly receives a rivet from the rivet feed assembly and then moves back to the first position for insertion of the rivet into a drilled opening in the workpiece wherein thereafter the rivet is upset.

2. The apparatus of claim 1, wherein the angled position is approximately 30°.

3. The apparatus of claim 1, including an air cylinder for moving the nose assembly between its first and second positions.

4. The apparatus of claim 1, including an injector assembly for moving rivets from the rivet ramp into a finger assembly when the nose assembly is in its second position.

5. The apparatus of claim 4, wherein the injector assembly includes a separator/slider mechanism and an air cylinder for moving the forward-most rivet on the rivet ramp out of the injector assembly and into the finger assembly.

6. The apparatus of claim 4, wherein the separator/slider is arranged at an angle of 30 degrees, matching the angle of the feed ramp and the second angled position of the nose assembly.

7. The apparatus of claim 1, including a plurality of rivet supply members moveably mounted along a side of the riveting apparatus.

* * * * *